United States Patent [19]

Long

[11] 4,306,914

[45] Dec. 22, 1981

[54] METHOD AND APPARATUS FOR CLEANING AND MAGNETIZING A PIPE

[75] Inventor: Thomas R. Long, Gretna, La.

[73] Assignee: Intracoastal Pipe Repair & Supply Co., Inc., Harvey, La.

[21] Appl. No.: 132,689

[22] Filed: Mar. 21, 1980

[51] Int. Cl.[3] ..... B08B 1/02; B08B 1/04; B08B 9/02

[52] U.S. Cl. ..... 134/1; 15/104.04; 15/104.1 R; 15/104.2; 134/8; 324/228

[58] Field of Search ..... 134/8, 18, 1; 15/104.04, 104.1 R, 104.2, 21 B, 21 D; 324/220, 221, 228, 263

[56] References Cited

U.S. PATENT DOCUMENTS

| | | | |
|---|---|---|---|
| Re. 26,537 | 3/1969 | Tompkins | 324/227 X |
| 1,871,798 | 8/1932 | King | 15/21 D |
| 2,549,659 | 4/1951 | Brendel | 15/104.2 X |
| 2,789,296 | 4/1957 | Cheadle | 15/104.2 |
| 3,535,623 | 10/1970 | Wood et al. | 324/220 |
| 3,535,624 | 10/1970 | Wood | 324/220 X |
| 3,539,915 | 11/1970 | Walters et al. | 324/220 |
| 3,824,646 | 7/1974 | Jai | 15/104.2 X |

FOREIGN PATENT DOCUMENTS

| | | | |
|---|---|---|---|
| 631988 | 11/1949 | United Kingdom | 324/220 |

*Primary Examiner*—Marc L. Caroff

*Attorney, Agent, or Firm*—Harvey B. Jacobson

[57] ABSTRACT

Piping such as oil country tubular goods are passed to an external cleaning apparatus comprising a plurality of rotating brushes for cleaning the pipe exterior. The pipe is transported longitudinally by a conveying apparatus which also causes transverse rotation of the pipe. A brush is contained at the end of a conductive spear and the pipe is passed over the brush while rotating to clean the internal surface thereof. Once the pipe is fully disposed on the spear, electrically conductive clamps attach to the spear just behind the brush. Current is passed through the spear to produce a circumferential magnetic field in the pipe wall which field is later sensed to determine the existence of anomalies in the pipe structure. The pipe is then removed from the spear by movement over the internal cleaning brush caused by activation of the conveying apparatus in a direction opposite to its original motion which again effects cleaning of the inside surface of the pipe.

11 Claims, 6 Drawing Figures

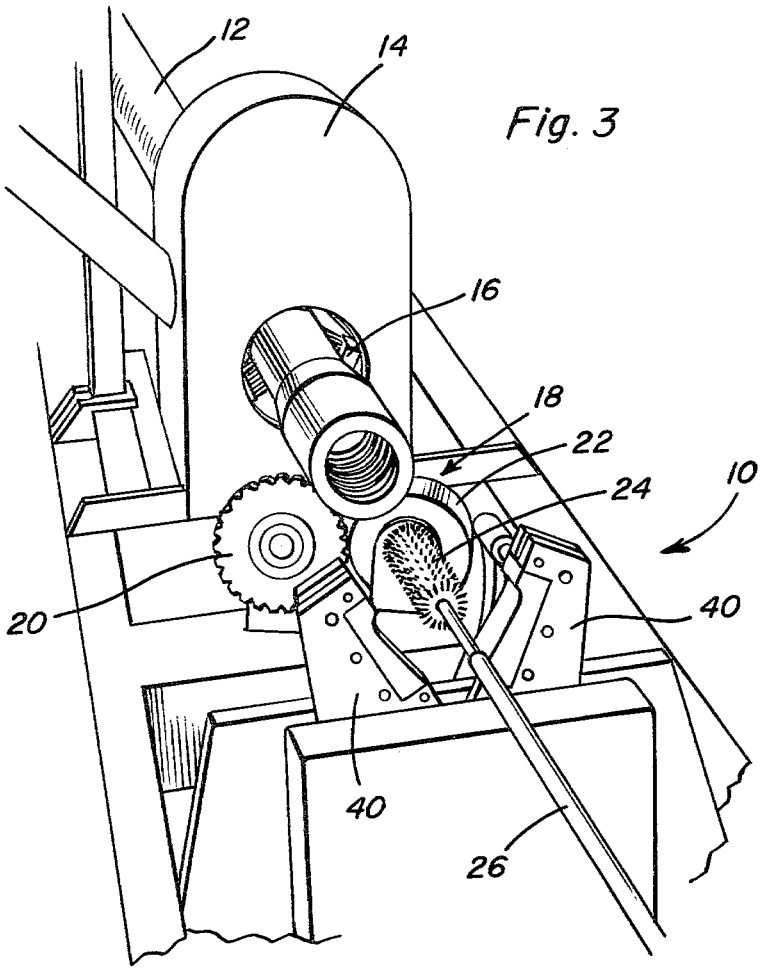
Fig. 3
Fig. 5
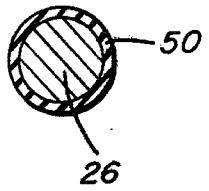
Fig. 6
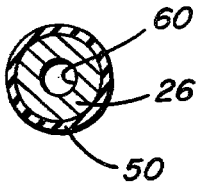
Fig. 4
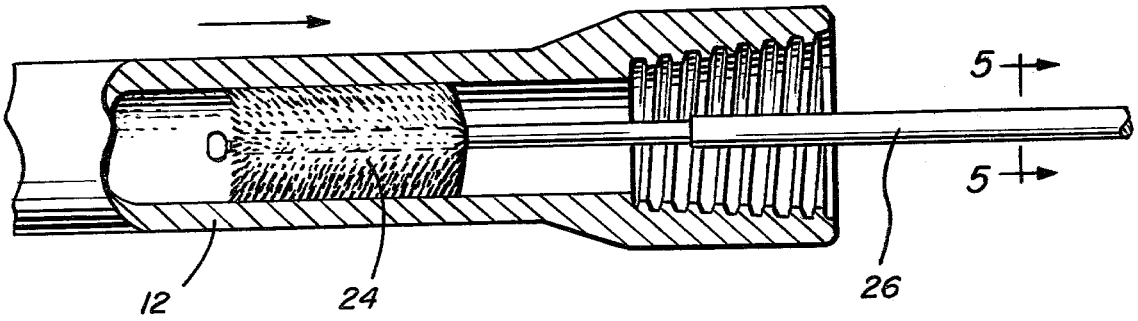

METHOD AND APPARATUS FOR CLEANING AND MAGNETIZING A PIPE

BACKGROUND OF THE INVENTION

1. Field of the Invention

This invention relates to apparatus for cleaning and magnetizing pipes prior to inspection of the pipes for anomalies which may later cause structural failure.

2. Discussion of Related Art

Oil country tubular goods commonly known as OCTG pipe must be thoroughly inspected prior to being placed in service. The most common and economical method of inspection is a technique known as magnetic flux leakage inspection. In this method, the pipe is magnetized and the flux diversion about a defect is found by means of electronic scan systems or magnetic powder applications. One of the methods of magnetization is to pass the current (in excess of 3000 amperes DC) through a conductor placed axially within the pipe. The current induces a circumferential magnetic field in the pipe. Imperfections in the pipe are outlined by the flux leakage to the inside or outside surface of the pipe.

In addition to the magnetization process, it is necessary to thoroughly clean the inside and outside surfaces of the pipe. This is done by passing the pipe through a machine which applies powered brushes to the outside and (by means of a brush mounted on a lance) inside surfaces of the pipe. The belief has long been held that cleaning pipe by any method subsequent to magnetization thereof would destroy the magnetic field and the ability to perform the inspection function. Accordingly, the cleaning and magnetization of pipe has always been carried out as separate operations.

U.S. Pat. No. Re. 26,537, reissued Mar. 4, 1969, to Tompkins, shows an apparatus for the inspection of longitudinal pipe members. The Tompkins device is preferably mounted in a van-type vehicle and includes electric motors for translating a tubular member longitudinally along a rack. The pipe is translated through the van by passing through the rear of the truck where a stationary inspection head inspects the pipe for circumferentially extending flaws. The pipe is then translated onto a rack to engage an axially centered conductor which is positioned in the pipe by motion of the pipe. The conductor conducts a surge of current to form a residual magnetic field in the wall of the pipe. U.S. Pat. No. 3,535,623, issued Oct. 20, 1970, to Wood et al, and U.S. Pat. No. 3,535,624, issued Oct. 20, 1970, to Wood, show devices for the inspection of tubular members wherein a rigid lance is mounted at an end and spaced from its free end are suitable centralizers, a circumferential set of inside surface detection shoes for detecting a longitudinal field and one or more inside surface detection shoes for detecting a circumferential field.

U.S. Pat. No. 3,539,915, issued Nov. 10, 1970, to Walters et al, shows a device for magnetizing sections of tubular goods wherein a circumferential flux is produced by high current pulses applied to successive overlapping longitudinal sections of a pipeline using axially spaced conductive brushes or spurs. A similar apparatus is shown in U.S. Pat. No. 3,593,122, issued July 13, 1971, to Barton et al. The Barton device includes an apparatus wherein hard spots are detected in a steel pipeline by measuring both active and residual magnetic flux fields. The magnetic flux field is produced by pole pieces which may be circular disks or radially extending spoked or webbed members which support at their peripheries respective wire brush members and which have flexible flux conducting bristles that make contact with the full circumference of the inner wall of the pipeline and conduct magnetic flux thereto.

SUMMARY OF THE INVENTION

One object of the present invention is to provide an apparatus which can clean and magnetize a length of tubular goods in one continuous operation.

A further object of the present invention is to provide a pipe cleaning and magnetizing apparatus which is relatively simple in construction and yet durable and effective in use.

An even still further object of the present invention is to provide a pipe cleaning and magnetizing apparatus which can perform the stated functions on a length of pipe automatically without the need of operator intervention.

In accordance with the above objects, the apparatus of the present invention includes an external pipe cleaning mechanism having a plurality of wire brushes which rotate about and contact the external periphery of a pipe section passing therethrough to effect cleaning of the external surface of the pipe. As the pipe is automatically translated past the brushes, it is rotated as well and contacts a single brush mounted on the end of a current conducting spear. The opposite end of the spear is fixedly mounted to a conducting plate and the spear is supported by a plurality of movable support stands. As the pipe is rotated and translated longitudinally over the brush, the internal surface of the pipe is cleaned and the pipe slides over the spear. As the pipe approaches each of the stands, the stands move out of the way and the pipe is used to support the spear which has an insulative coating disposed about its periphery. Once the pipe is fully disposed on the spear, a current conductive clamp engages the end of the spear containing the brush and current is passed through the spear to provide a circumferential magnetic field which magnetizes the pipe. The pipe is then moved oppositely from its original motion and removed from the spear and wire brush which again effects cleaning of the inside surface of the pipe.

These together with other objects and advantages which will become subsequently apparent reside in the details of construction and operation as more fully hereinafter described and claimed, reference being had to the accompanying drawings forming a part hereof, wherein like numerals refer to like parts throughout.

BRIEF DESCRIPTION OF THE DRAWINGS

FIG. 3 is a detailed view of the current conducting clamps in the open position to allow the pipe to pass onto the spear.

FIG. 4 is a detailed view showing movement of the pipe over the internal cleaning brush.

FIG. 5 is a sectional view taken substantially along a plane passing through section line 5—5 of FIG. 4 showing the spear and its insulative coating.

FIG. 6 is a sectional view of the hollow spear used to operate an air motor for cleaning.

DESCRIPTION OF THE PREFERRED EMBODIMENT

Figure 1:
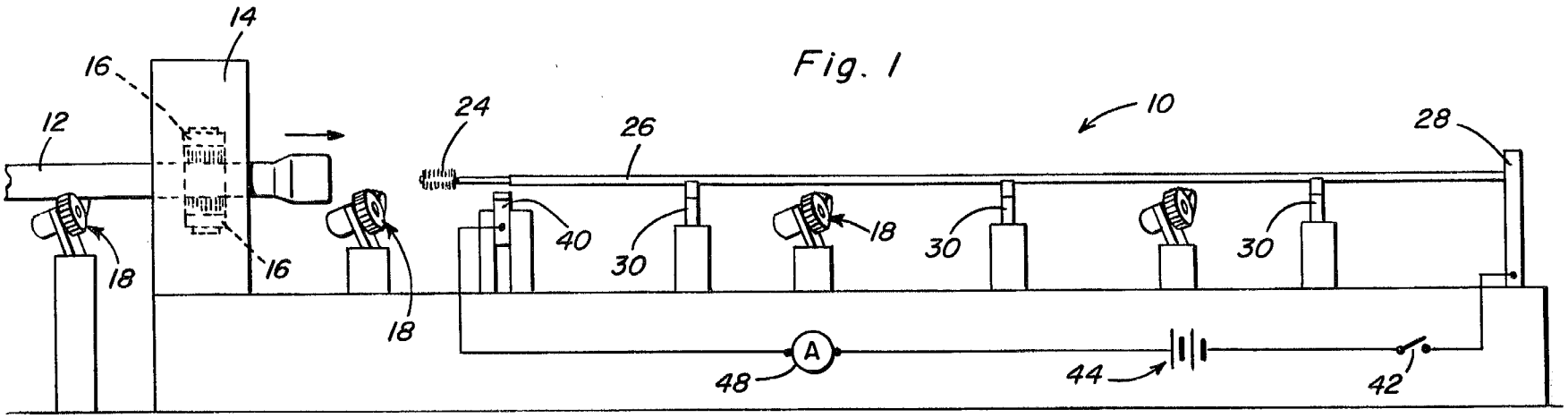
FIG. 1 is a partially schematic view showing the pipe being moved through the external cleaning brush assembly.

Now with reference to the drawings, a pipe cleaning and magnetizing apparatus incorporating the principles and concepts of the present invention and generally referred to by the reference numeral 10 will be described in detail.

With particular reference to FIGS. 1 and 3, it can be seen that a length of pipe 12 is passed through a housing 14 in which the external surface of the pipe is cleaned by a plurality of brushes 16 which rotate about and contact the outer periphery of the pipe. Pipe 12 is moved through the housing 14 by a conveying apparatus comprising a plurality of pairs of rollers 18 which, as shown in FIG. 3, include one driven roller 20 and one idler wheel 22 which are canted slightly to cause both longitudinal translation and transverse rotation of the pipe 12. Accordingly, the circumference of the pipe is thoroughly cleaned and freed from debris.

Figure 2:
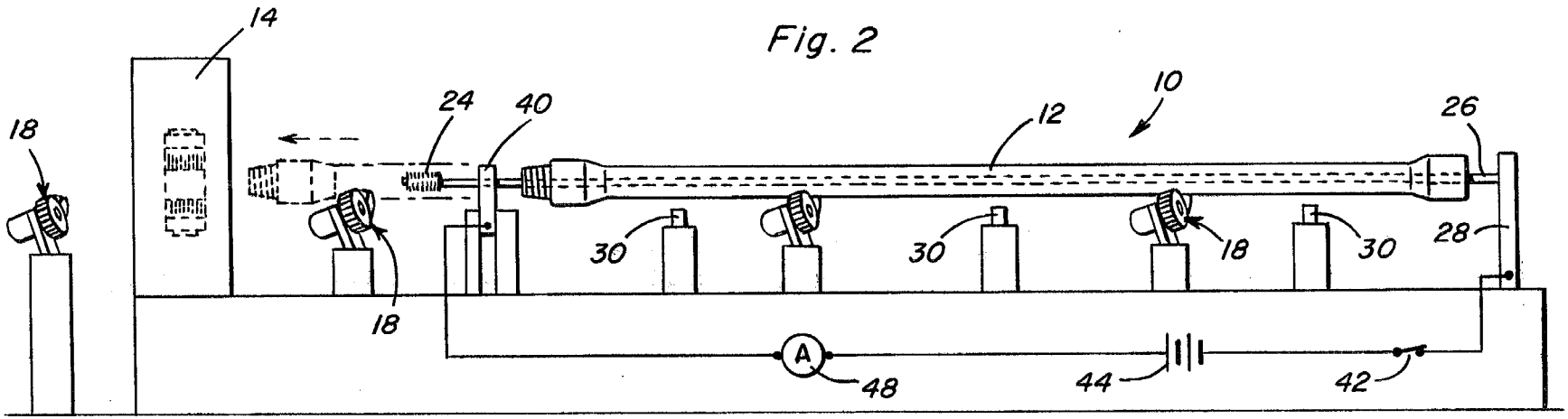
FIG. 2 is a partial schematic view of the pipe being moved over the internal cleaning brush and being disposed on the current conductive spear.

The pipe passes along roller pairs 18 and encounters brush 24 which is mounted by any suitable means on the end of a conductive spear 26. Brush 24 is fixed to the spear which is itself fixed to a mounting plate 28. Brush 24, as shown in FIG. 4, is slightly larger than the internal diameter of the pipe 12 and thus cleans the internal surface of the pipe. The cleaning effect is enhanced by the rotation of the pipe as it passes over the brush. Spear 26 is supported by a plurality of vertically movable support members 30 which hold the spear in alignment with pipe 12 in order to insure that brush 24 will be inserted in the open end of that pipe. As the pipe progresses along the spear 26, suitable sensors, such as electric eyes or the like which are located in proximity to the vertical support members cause each of the support members to retract as clearly shown in FIG. 2 as would be obvious to one of ordinary skill in the art. Accordingly, when pipe 12 is fully disposed on the spear 26 as shown in FIG. 2, the spear is supported by the pipe which rests on roller pairs 18. The roller pairs are automatically stopped by additional suitable sensors which can be located on mounting plate 28 or in any other available location as would also be obvious to one of ordinary skill in the art.

A pair of conductive clamp jaws 40 are mounted to engage the end of spear 26 just behind brush 24 after pipe section 12 is fully mounted on the spear. Jaws 40 can be automatically operated by the use of appropriate sensors as would be apparent to one of ordinary skill in the art and serve to complete an electrical connection which is made between plate 28, spear 26 and jaws 40. Accordingly, when switch 42 is closed, a DC power source, as represented by battery 44, is effective to provide power through the spear 26 thereby producing a circumferential magnetic field causing a residual magnetism to be produced in the pipe 12. An ampere meter 48 can be inserted in the circuit in order to insure that a current of greater than 3000 amperes is produced to insure adequate residual magnetism in the pipe section 12 for effective sensing of anomalies in the pipe. Again, operation of switch 42 can be performed automatically by appropriate sensors positioned on jaws 40 such that switch 42 is closed after the jaws close on the end of spear 26. By use of spear 26 a circumferential magnetic field is formed. The application of the circumferentially disposed magnetic field in the pipe eliminates the natural characteristics of a longitudinal magnetic field. A longitudinal field attracts and holds ferrous particles which interfere with the inspection process. Thus, the application of a circumferential magnetic field during the cleaning cycle causes an improvement in the cleaning process by preventing the magnetic particles from being attracted to the pipe.

During the magnetization process, it is preferable that no current pass through the pipe itself. Accordingly, the spear 26 is coated with an insulative coating such as Teflon 50 as shown in FIG. 5. The Teflon is suitable for centering the spear within the pipe for small diameter pipes. For larger diameter pipes, radial projection in the form of Neoprene attachments can be connected to the spear to insure that the spear is centered and thus the production of a uniform field in the pipe is insured.

Once the pipe 12 is magnetized, the conveyor mechanism including roller pairs 18 is reversed thus causing the pipe to move off the spear 26 again passing over brush 24 and through external cleaning housing 14. Thus, both the inside and the outside of the pipe are cleaned twice during the process, once before and once after the application of the magnetic field to the pipe.

After the pipe is removed from the cleaning and magnetizing apparatus 10, it is passed to an inspection station for detection of anomalies such as cracks or the like which exist in the pipe and may affect its structural integrity. Such inspection stations are known in the art and form no part of the present invention.

Alternatively, spear 26 can be hollow as shown in FIG. 6 at 60 to permit the passage of air through the center as well as current through the outer surface. Brush 24 can be a standardly available air motor such as sold by Air Tool Inc. to thoroughly clean the inner surface of pipe 12. The air motor drives a rotating brush or any other type of cleaner.

The foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as new is as follows:

1. An apparatus for cleaning and magnetizing an elongated tubular member in one operation, comprising: an elongated current conductive rod having a diameter less than the internal diameter of the tubular member being cleaned and magnetized; cleaning means having a surface contacting diameter slightly greater than the internal diameter of the tubular member; said cleaning means being fixedly attached to one end of said rod; conveyor means causing relative translation of said rod and the tubular member to establish a cleaning cycle for cleaning the interior of the tubular member by contact with said cleaning means and electrical means connected to the rod for establishing a residual magnetic field throughout the tubular member during a portion of said cleaning cycle, said magnetic field being circumferentially oriented to prevent attraction of magnetic particles to the tubular member during said portion of the cleaning cycle.

2. The invention as defined in claim 1 wherein said conveyor means includes conveyor elements which cause both longitudinal translation and transverse rotation of the tubular members being cleaned and magnetized.

3. The invention as defined in claim 2 wherein said cleaning means is on a free end of said rod such that the cleaning means enters an open end of the tubular member being cleaned and magnetized, said conveyor means causing the tubular member to pass entirely over the cleaning means, the length of said rod being greater than the length of the tubular member such that the cleaning means emerges from the opposite end of the tubular member.

4. The invention as defined in claim 3 wherein said electrical means includes a pair of electrically conductive jaws movable between an open position and a closed position engaging said rod, said jaws being contained in a circuit for supplying current to said rod.

5. The invention as defined in claim 4 wherein said rod has an insulative coating.

6. The invention as defined in claim 1 and further including an external cleaning apparatus comprising a plurality of rotating brushes which rotate through an arc about the circumference of a tubular member to be cleaned.

7. The invention as defined in claim 1 wherein said rod is supported by a plurality of movable support members, each of said support members being capable of movement away from said rod upon the approach of a tubular member to be cleaned and magnetized.

8. The invention as defined in claim 1 wherein said cleaning means comprises a brush.

9. The invention as defined in claim 1 wherein said rod is hollow and said cleaning means comprises an air operated motor.

10. A method of cleaning and magnetizing in one continuous operation a tubular member translated and rotated relative to a surface contacting element, including the steps of: imparting relative movement to the tubular member and the surface contacting element during a cleaning cycle for cleaning an interior surface of the tubular member; applying electrical current to a conductive component of the surface contacting element to establish a residual magnetic field throughout the tubular member orientated to prevent attraction of magnetic particles to the surface; and performing a portion of the cleaning cycle while said magnetic field resides within the tubular member.

11. The method of claim 10 wherein said magnetic field is circumferentially orientated with respect to the tubular member.

* * * * *